US006823779B2

(12) United States Patent
Machida

(10) Patent No.: US 6,823,779 B2
(45) Date of Patent: Nov. 30, 2004

(54) IMAGE PROCESSING METHOD, IMAGE FORMATION METHOD, IMAGE PROCESSING APPARATUS, AND IMAGE FORMATION APPARATUS

(75) Inventor: Miho Machida, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/385,748

(22) Filed: Mar. 12, 2003

(65) Prior Publication Data

US 2004/0037583 A1 Feb. 26, 2004

(30) Foreign Application Priority Data

Aug. 20, 2002 (JP) ..... 2002-239830

(51) Int. Cl.[7] ..... B31F 1/07; B41F 13/48

(52) U.S. Cl. ..... 101/32; 101/23; 101/382.1

(58) Field of Search ..... 101/23, 3.1, 27, 101/487, 395, 382.1, 483, 32, 78; 358/1.9, 3.27; 399/100; 347/224

(56) References Cited

U.S. PATENT DOCUMENTS 6,182,894 B1 * 2/2001 Hackett et al. ..... 235/380
6,202,155 B1 * 3/2001 Tushie et al. ..... 713/200
6,352,206 B1 * 3/2002 Ashley et al. ..... 235/475
6,361,784 B1 * 3/2002 Brennan et al. ..... 424/402
6,440,530 B1 * 8/2002 Jud ..... 428/141
6,464,831 B1 * 10/2002 Trokhan et al. ..... 162/134
6,484,780 B2 * 11/2002 Ashley et al. ..... 156/540
6,534,158 B2 * 3/2003 Huang et al. ..... 428/201
6,568,931 B2 * 5/2003 Fujii et al. ..... 425/194
2001/0035257 A1 * 11/2001 Fujii et al. ..... 156/212
2003/0028481 A1 * 2/2003 Flitcroft et al. ..... 705/39

FOREIGN PATENT DOCUMENTS

| | | | |
|---|---|---|---|
| JP | A 6-320855 | 11/1994 | |
| JP | A 7-175201 | 7/1995 | |
| JP | 2001-134006 | * 5/2001 | ..... G03G/9/08 |
| JP | A 2001-194846 | 7/2001 | |
| JP | A 2002-244384 | 8/2002 | |
| JP | A 2002-278370 | 9/2002 | |

* cited by examiner

*Primary Examiner*—Daniel J. Colilla
*Assistant Examiner*—Wasseem H. Hamdan
(74) *Attorney, Agent, or Firm*—Oliff & Berridge, PLC

(57) ABSTRACT

An image formation method and apparatus extract an attribute value from a non-embossed image data from which a non-embossed image is formed, generate an embossed image data from which an embossed image is formed using the extracted attribute value, and form an image based on the generated embossed image data and the non-embossed image data.

8 Claims, 8 Drawing Sheets

FIG.5
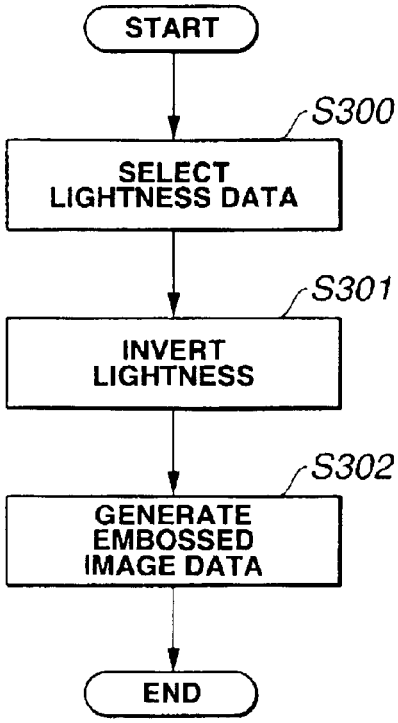
FIG.6A
FIG.6B
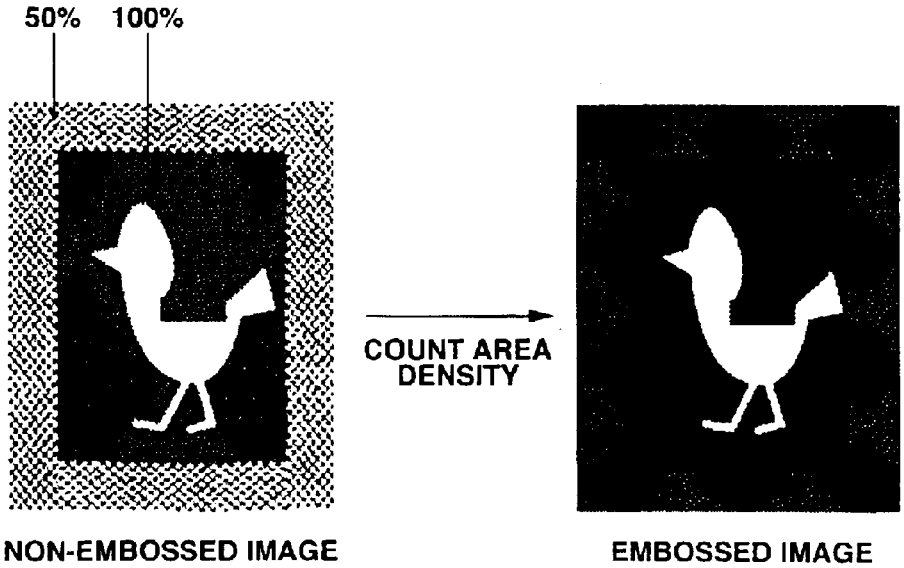

NON-EMBOSSED IMAGE

DETECT EDGE
GENERATE CONTOUR DATA

EMBOSSED IMAGE

EMBOSSING IS SPECIFIED

NON-EMBOSSED IMAGE

REGION TO BE EMBOSSED IS CUT OUT

LIGHTNESS
↓
INVERSION
↓
x COLORFULNESS DATA

EMBOSSED IMAGE

IMAGE PROCESSING METHOD, IMAGE FORMATION METHOD, IMAGE PROCESSING APPARATUS, AND IMAGE FORMATION APPARATUS

BACKGROUND OF THE INVENTION

1. Field of the Invention

The present invention relates to an image formation method and the system thereof. In particular, the present invention relates to an image formation method and the system thereof for forming an embossed image having a three-dimensional physical substance based on a non-embossed image.

2. Description of the Related Art

Printed matter obtained by forming a non-embossed image that extends in two-dimension on a printing medium such as recording paper is widely used in various daily scenes.

There is also printed matter in which an embossed image made of physical substance is present in a non-embossed image printed on the printed medium. The presence of such an embossed image adds the printed matter to values such as:

Portions printed as a non-embossed image can also be recognized as pseudo-embossed image;

Texture of oil paintings, wallpaper, etc. can be expressed;

Characters or patterns can be emphasized by raising them from the surface of the printed matter, and the printed matter can have a high-quality appearances by partially raising the image printed thereon; and Image on the printed matter can be appreciated with the sense of touch in addition to visual sense, thus the printed matter can be enjoyed also by visually-handicapped people, making printed matter universal.

The conventional methods of forming an embossed image includes a method in which an embossed image was formed by preparing a data representing the embossed image, irradiating a light beam to a photo-curing resin sheet by using this data to form a resin plate, and pressing the resin plate against a printing medium such as recording paper to form the embossed image on the medium.

However, this conventional method requires processes such as preparing an embossed sample corresponding to the embossed image to be printed and measuring and/or processing the surface shape of the embossed sample. Therefore, this conventional method requires to prepare an embossed shape corresponding to an image to be printed from scratch, thereby requiring large amount of labor, time and cost.

Japanese patent laid-open No. 7-175201 discloses a method of manufacturing an embossing die corresponding to the gradation of an image by irradiating a light beam to a photosensitive resin plate via a photograph film, and developing the image.

This method is a thermosensitive type in which data representing a height of the image is directly written depending on an amount of light passing through a film. Because a photographic film or the like is required, this method has not been widely used in other methods.

Further, Japanese patent laid-open No. 6-320855 discloses a method of forming on a non-embossed image a ultraviolet curable transparent resin layer having a height corresponding to the color image density of the non-embossed image.

In this method, however, a resultant image did not always provide a visual embossed effect because a portion having a high density such as a shadow portion is incorrectly represented as a protruding shape.

This method also has a problem in that due to a lens effect of the embossed transparent resin layer through which the non-embossed image is observed, a resultant image is caused to be visually deformed.

SUMMARY OF THE INVENTION

The present invention has been made in view of the above circumstances, and provide an image processing and formation method and the apparatus thereof in which an embossed image can be easily formed regardless of the types of image to be formed.

In one aspect of the present invention, an image processing method comprises the steps of extracting an attribute value from a non-embossed image data from which a non-embossed image is formed; generating an embossed image data from which an embossed image is formed using the extracted attribute value; and transmitting the generated embossed image data and the non-embossed image data to an image formation apparatus.

In another aspect of the present invention, an image formation method comprises the steps of extracting an attribute value from a data of a non-embossed image from which the non-embossed image is formed; generating an embossed image data from which the embossed image is formed using the extracted attribute value; and forming an image based on the generated embossed image data and the non-embossed image data.

In still another aspect of the present invention, an image processing apparatus comprising attribute value extract means for extracting an attribute value from a non-embossed image data from which a non-embossed image is formed; embossed image data generation means for generating an embossed image data from which an embossed image is formed using the attribute value extracted by the attribute value extract means; and transmission means for transmitting the embossed image data generated by the embossed image data generation means and the non-embossed image data to the image formation apparatus.

In further aspect of the present invention, an image formation apparatus comprises attribute value extract means for extracting an attribute value from a non-embossed image data from which a non-embossed image is formed; embossed image data generation means for generating an embossed image data from which an embossed image is formed from the attribute value extracted by the attribute value extract means; and image formation means for forming an image based on the embossed image data generated by the embossed image data generation means and the non-embossed image data.

According to the present invention, an embossed image can be easily provided by using a non-embossed image data.

Further, according to the present invention, the shape and height of an embossed image as well as a region in which on embossed image is formed can be determined according to a user's desire or preference so that printed matter of high quality of design can be produced.

Further, with the use of electrophotograph image formation apparatus capable of forming an embossed image with foaming toner or the like, the present invention can produce a product having multiplicity of types in small amount in an on-demand manner.

embossed image formation apparatus according to the present invention can form an embossed image with the operation as easy as the operation of conventional electronic photograph apparatuses, and therefore end-users can also operate the apparatus by themselves.

BRIEF DESCRIPTION OF THE DRAWINGS

Embodiments of the present invention will be described in detail based on the following drawings, wherein

FIG. 5 is a flowchart illustrating a process of generating an embossed image data with respect to oil painting, wallpaper or the like;

FIGS. 6A and 6B illustrate the generation of an embossed image data with respect to engraving;

FIG. 7 is a flowchart illustrating a process of generating an embossed image data with respect to engraving, design picture or the like;

DESCRIPTION OF THE EMBODIMENTS

Embodiments of an image processing and formation method according to the present invention and the apparatus thereof will be described with reference to the accompanying drawings.

Figure 1:
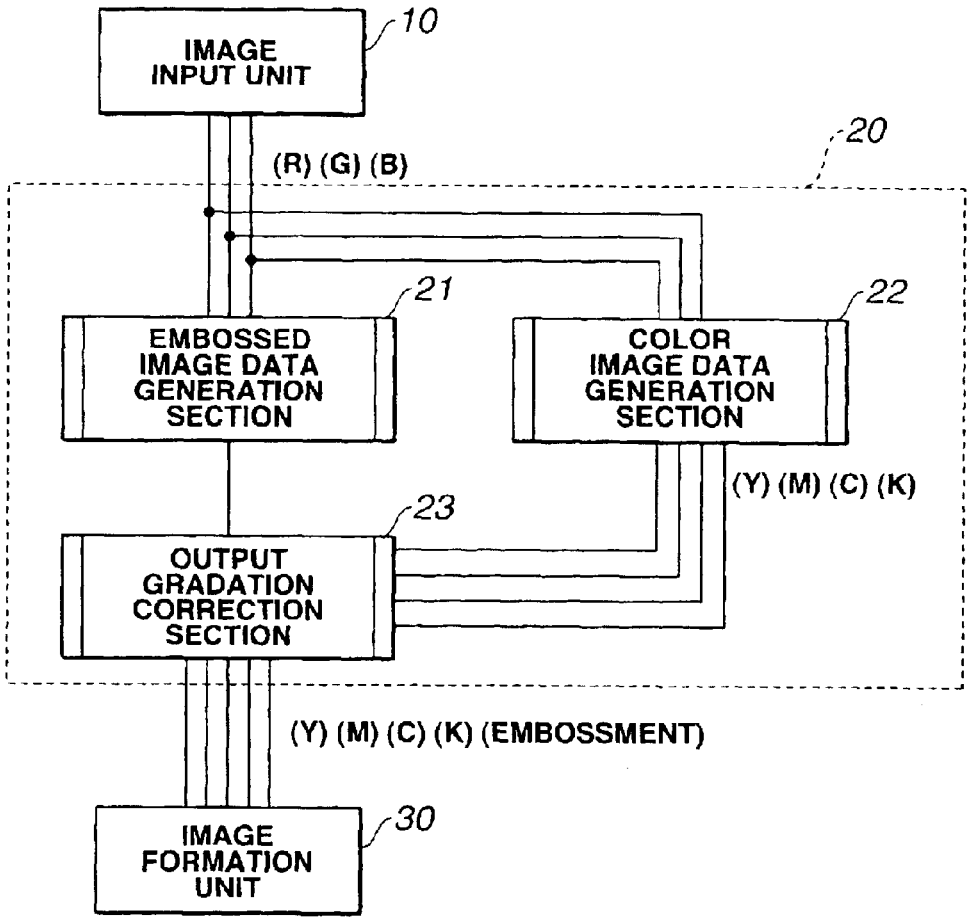
FIG. 1 is a block diagram schematically illustrating an example of configuration of a system using an image formation method according to the present invention.

FIG. 1 is a block diagram schematically illustrating an example of the configuration of an image formation apparatus using the image formation method according to the present invention. The image formation apparatus comprises an image input unit 10 for inputting data of a non-embossed image (an image extending in a two-dimensional direction), such as a scanner and an image reader which reads image data from a recording medium of a digital camera; an image processing unit 20 for processing non-embossed image data to generate embossed image data including the data on height; and an image formation unit 30 for forming an image based on the image data.

The image processing unit 20 comprises an embossed image data generation section 21 for generating embossed image data based on non-embossed image data; a color image data generation section 22 for generating color image data based on the colors of a non-embossed image; an output gradation correction section 23 for correcting an output gradation; and a user interface (not shown) through which a user sends commands for performing a processing to form a desired embossed image.

The image formation unit 30 is capable of forming a color image by using color toners and also forming an embossed image by using an embossing material. An example of the image formation unit 30 is an electrophotographic formation apparatus that forms an embossed image by using foaming toners consisting of a resin having property of integrity and foaming agent, whose volume is expanded by a heat generated when the toners are fixed.

An original picture in a printed matter is input as an image data by the image input unit 10 such as a scanner and is sent to the image processing unit 20 as a color digital data consisting of RGB or a monochrome digital data.

Then, the embossed image data generation section 21 of the image processing unit 20 generates an embossed image data for forming an embossed image based on the image data and sends the embossed image data to the output gradation correction section 23.

A portion where the gradation value of the embossed image data is at maximum (e.g., 100), this portion of the embossed image is formed highest that the image formation apparatus can form. A portion where the gradation value is at minimum (e.g., 0), the height of this portion is formed lowest.

For forming the colors of a non-embossed image, the color image data generation section 22 performs color conversion on the received RGB or monochrome image data to meet with the color of a recording material used in the image formation apparatus, and transmits the obtained color image data to the output gradation correction section 23.

Then, the output gradation correction section 23 performs output gradation correction for the embossed image data and the color image data, superposes the embossed image data with the color image data to form superposed image formation data, and transmits the superposed image formation data to the image formation unit 30. Instead of being superposed, the embossed image data may simply be synthesized with the color image data.

Alternatively, the output gradation correction section may be constructed such that an embossed image and a color image are not superposed one over another and an embossed image data for forming an embossed image and a color image data for forming a color image are transmitted to the image formation apparatus.

The image formation unit 30 forms a superposed image obtained by superposing the color image with the embossed image based on the superposed image data.

Upon receiving the data for forming an embossed image and the data for forming a color image, the image formation unit 30 forms an embossed image and a color image based on these received data, respectively.

Figure 2:
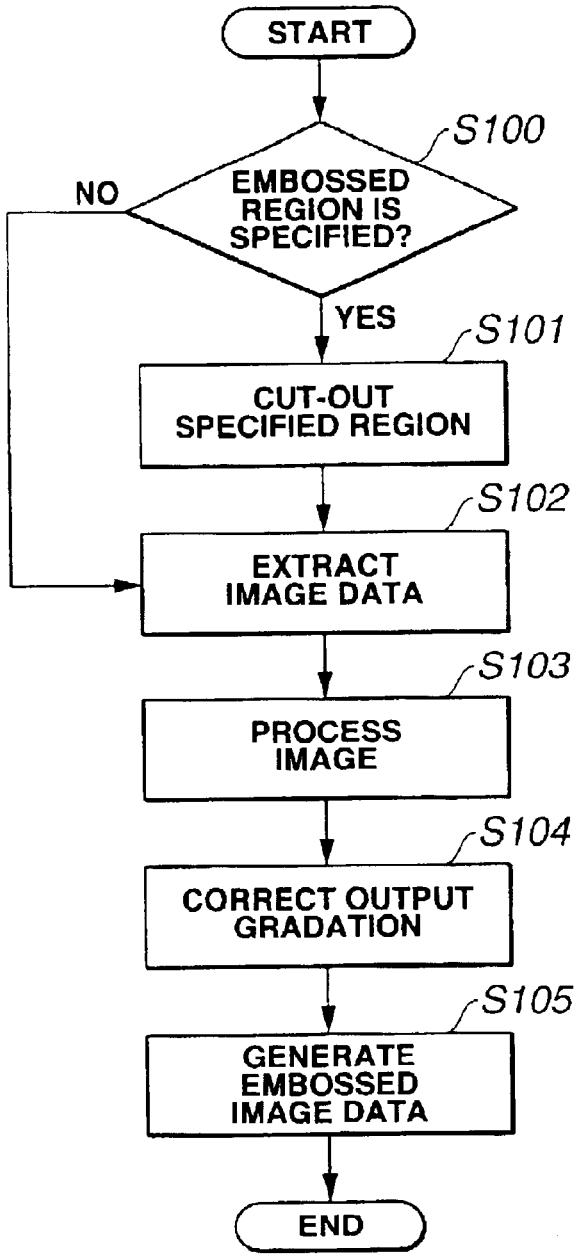
FIG. 2 is a flowchart illustrating a process of generating an embossed image data according to an embodiment of the present invention.

Next, the flow of the image processing in the present embodiment will be described with reference to FIG. 2.

When an image data is input, it is determined whether an embossed image region for forming an embossed image is specified (step 100). When it is determined that an embossed image region is specified (step 100: YES), then an image in the specified region is cut out (step 101) and an image attribute data (i.e., attribute values: lightness, colorfulness, contour, density) is extracted (step 102).

When it is determined that s embossed image region is not specified (step 100: NO), then the image attribute data is extracted from the image data in all regions (step 102).

Then, an image data processing is performed to form an embossed image according to a type of a non-embossed image specified by a user (i.e., oil painting, wallpaper, engraving work, design picture, line diagram, tactile graphics, photograph, or landscape picture) or according to the attribute value used for the conversion (lightness (B), colorfulness (S), edge (E) that represents the contour of an image, or image density (C)(including a designation of negative or positive)) (step 103).

When the attribute value of a non-embossed image is directly specified, the type of the image is determined based on the attribute value and the gradation is inverted when it is necessary, thereby generating an embossed image.

Then, the output gradation of the embossed image is corrected (step 104), and the embossed image data is generated (step 105).

In the output gradation correction, processes specified by a used are performed with respect to, for example, height or embossed shape.

For example, the height of an image to be actually formed has upper and lower limits determined by a capability or a setting of the image formation apparatus, and thus the gradation correction is performed by specifying a certain height or a stepwise level of high, medium or low.

The sharpness of the embossed shape is determined by the curve of the gradation. When it is desired that an embossed shape should be sharper, an inclination of the gradation is increased. When it is desired that an embossed shape should be milder, an inclination of the gradation is decreased. In such a way, the gradation curve can be adjusted to control the sharpness of the embossed shape depending on a preference of a user.

Figure 3:
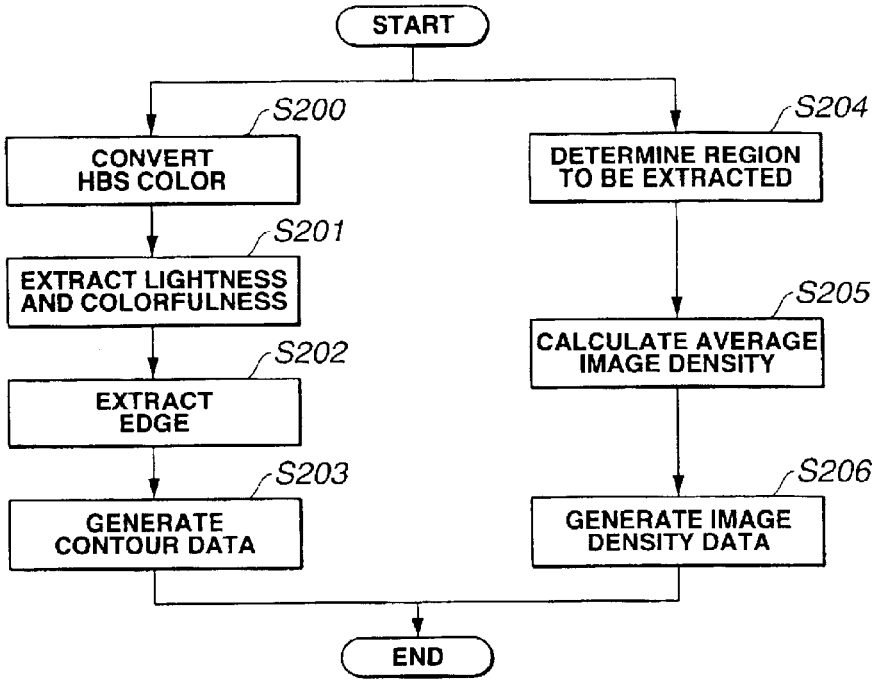
FIG. 3 is a flowchart illustrating a image data processing according to the embodiment.

FIG. 3 is a flowchart illustrating the flow of a processing in which the image attribute data is extracted from an image data.

First, an image data, which is an image attribute data of RGB or monochrome image, is subjected to a color conversion based on the HSB model in which the data are expressed in terms of lightness, colorfulness and hue (step 200), and the data on lightness (B) and colorfulness (S) is extracted (step 201).

In this process, the lightness data takes a value within the range of 0% (black) to 100% (white) and the colorfulness data takes a value within the range of 0% (gray) to 100% (saturated color). These values are used as multi-value data.

Then, the edge of the image is detected from the data on lightness (B) and colorfulness (S) (step 202), thereby generating a contour data (E) in which some particular periphery pixels along the edge direction are taken as the contour (step 203).

To detect an edge, there is a method that comprises the steps of calculating an average pixel value (i.e., average value of lightness or colorfulness) within a pixel unit area, and performing a differentiation processing on the average pixel value, thereby detecting the edge and the direction thereof.

The contour data is generated so that the contour part has a value of 100 and regions other than the contour part have a value of 0.

The process of extracting the image attribute data of an image density from an image data is as follows.

First, a non-embossed image is divided into plural image density extract regions consisting of pixel units each containing a certain number of pixels (step 204).

Each of the image density extract regions has a size which is difficult to visually identify, but is larger than the resolution of the image input unit such as CCD or scanner. In the case where a non-embossed image is a digital image obtained by a digital camera or the like, each of the image density extract regions has a size which is larger than the resolution when the non-embossed image is prepared and which is difficult to be visually identified.

Then, an average image density of the image density extract regions is calculated based on the image data (i.e., image data of RGB or monochrome image) (step 205), an image density data is generated based on the average image density of the image density extract regions (step 206).

The average image density is a percentage of the area where an image is formed with respect to a unit area, and takes a value from 0 to 100%.

In this way, the attribute value of a non-embossed image (i.e., lightness (B), colorfulness (S), edge (E), and image density (C)) are extracted from the image data to generate four types image attribute data which take a value from 0 to 100.

Alternatively, it may be so configured that only necessary image attribute data is extracted from an image data according to the type of a non-embossed image specified by a user (e.g., oil painting, wallpaper, engraving, design picture, line diagram, tactile graphics, photograph, and landscape picture) or the attribute value (including specifying of negative or positive) used for the conversion.

Referring now to FIG. 4, an exemplary flow of an image data processing for selecting and combining image data to generate an embossed image data, when a type of an image is specified, will be described.

Figures 4A, 4B, 4C:
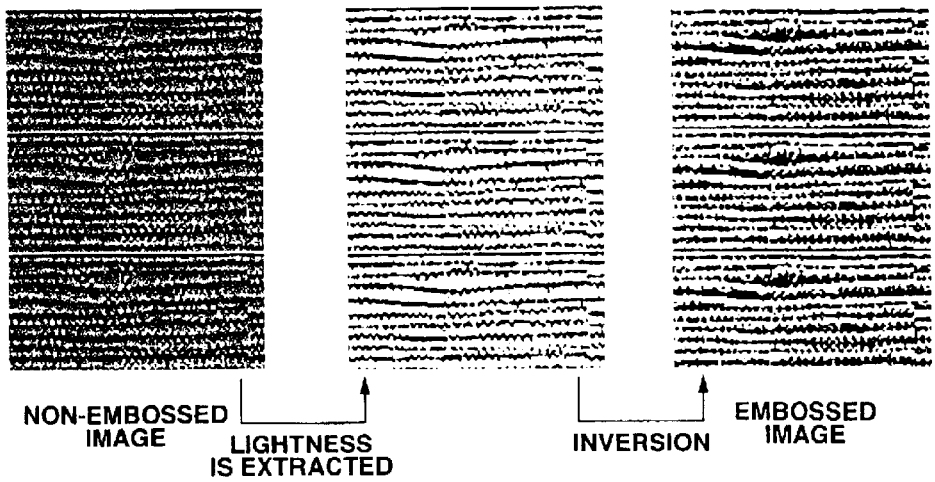
FIGS. 4A, 4B and 4C illustrate the generation of embossed image data with respect to wallpaper.

FIG. 4 is a non-embossed diagram illustrating an exemplary image processing for generating an embossed image (FIG. 4C) from a non-embossed image (FIG. 4A) whose type of image is oil painting or wallpaper.

Non-embossed image such as oil painting or wallpaper contains minute embossed shapes and has a unique texture different from a flat pattern of the picture.

When the image of wallpaper is read by a CCD scanner or photographed by a digital camera, the image is irradiated by the illumination of the scanner or camera. As a result, raised portions of the image show brighter lightness and colorfulness than in the surrounding portions thereof by reflection of the illumination because the raised portions have heights that receive greater amount of illumination than in the surrounding portions. Therefore, the CCD or the digital camera captures brighter image in the raised portions.

On the other hand, sunken portions receive the shadow from the raised portions. As a result, the sunken portions are captured by the CCD or the digital camera as an image data which is darker and less colorful than the raised portions, even though the same color of a recording material is used for the sunken portions and the raised portions.

In other words, each portion of such an image as above has lightness and colorfulness whose values have a correlation with the actual shape and height of the portion.

For generating an embossed image data, either lightness or colorfulness may be used, or alternatively, the values resulting from multiplication and addition of both lightness and colorfulness may be used.

It is noted that the smaller the value of lightness is, the higher lightness is, and the smaller the value of colorfulness is, the lower colorfulness is. Thus, the lightness value and the colorfulness value must be used taking this into consideration.

FIG. 5 is a flowchart illustrating an exemplary flow of the generation process of an embossed image data of the non-embossed image shown in FIG. 4, whose type of image is oil painting or wallpaper. The generation process comprises the following steps.

First, lightness data representing the lightness of the non-embossed image is selected from the image attribute data (step 300).

Then, gradation (lightness) of the lightness data is inverted (step 301) and an embossed image data is generated (step 302).

FIG. 6 illustrates an exemplary image processing for generating an embossed image data based on a non-embossed image of engraving. The non-embossed image in FIG. 6A consists of regions having image area densities of 100%, 50% and 0% for each pixel region unit.

In an engraving or a design picture as shown in FIG. 6, the shape of the engraving or the design picture is expressed by presence or absence of colors, and embossed shapes are formed in colored regions. Therefore, lightness or an image area density is used to generate an embossed image data.

Figure 7:
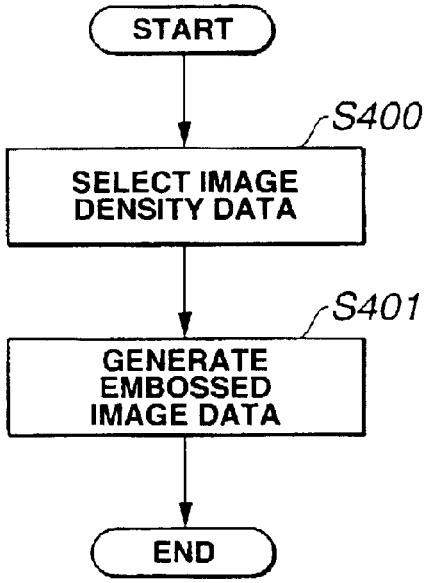

FIG. 7 is a flowchart illustrating an exemplary flow of a process for generating an embossed image data based on the non-embossed image shown in FIG. 6A whose type of image is engraving. The process comprises the following steps. First, image density data representing the image density of the non-embossed image is selected from the image attribute data (step 400).

Then, a region having 100% of image density is assigned a value of 100 and a region having 50% of image density is assigned a value of 50, thereby generating an embossed image data (step 401).

When an embossed image data has a value of 100, this value corresponds to the maximum height of an image which can be formed by the image formation apparatus. When an embossed image data has a value of 0, this value is the minimum height of an image which can be formed by the image formation apparatus.

FIG. 8 illustrates an exemplary image processing for generating an embossed image based on a non-embossed image whose type of image is map expressed as line picture.

Figure 8A:
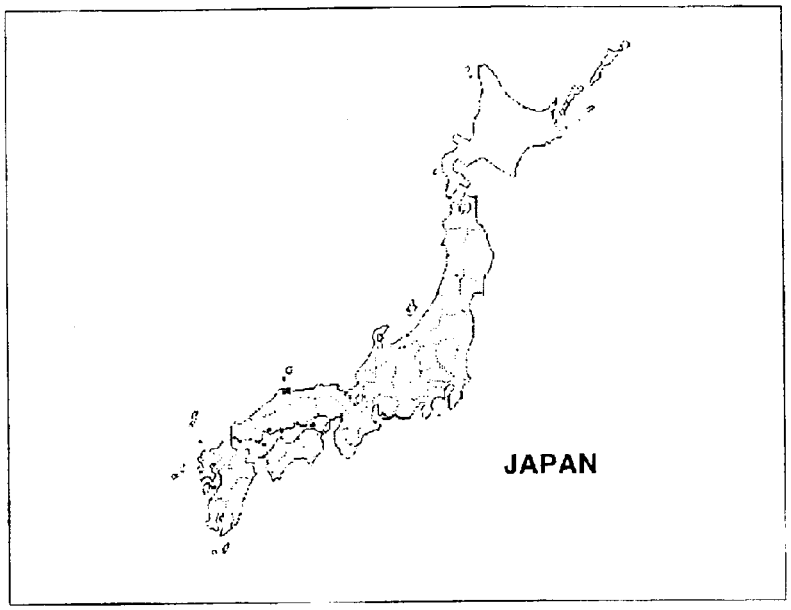
FIGS. 8A and 8B illustrate the generation of an embossed image data with respect to line map.
Figure 8B:
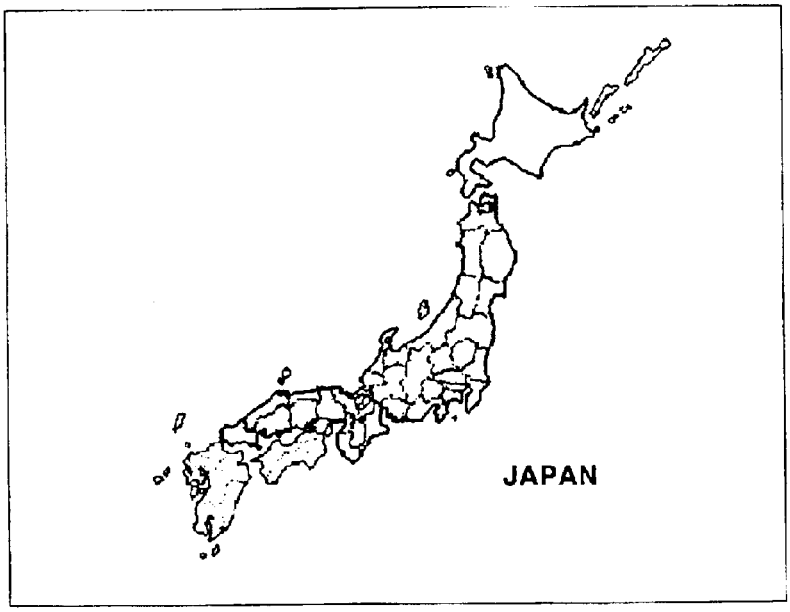

In the image of the line picture as shown in FIG. 8A, the contour of the map is represented by line. On the other hand, in the image of the tactile graphics in FIG. 8B, a raised portion having a sufficient height is formed along the contour of the picture, thereby allowing a visually-handicapped person to recognize the shape of the picture with his or her fingers.

Thus, when preparing a tactile graphics based on a line diagram, the edge of the line diagram is detected to generate a contour data.

In the preparation of a tactile graphics based on a line picture, the thickness of a contour part (raised portion) to be generated can be externally specified.

Alternatively, in addition to the result of detecting the edge direction, an embossed image data may also be configured in which a whole region enclosed by a contour is formed with an equal height.

Figure 9:
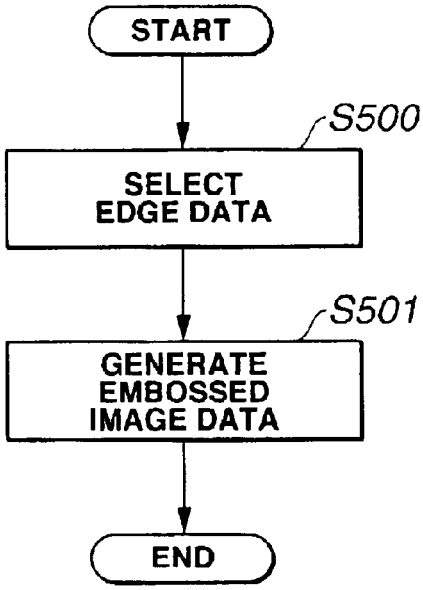
FIG. 9 is a flowchart illustrating a process of generating an embossed image data with respect to line map or tactile graphics.

FIG. 9 is a flowchart illustrating an exemplary flow of a process for generating an embossed image data based on a non-embossed image as shown in FIG. 8A which a map drawn in line. The process comprises the following steps. First, edge data representing the contour of the non-embossed image is selected from the image data (step 500). Then, the selected edge data is used to generate an embossed image data (step 501).

Figure 10A:
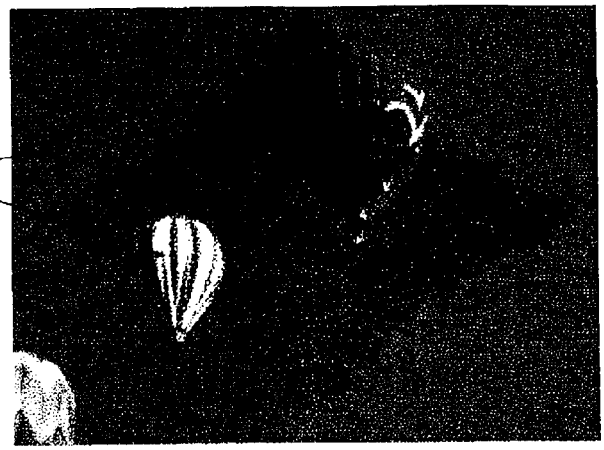
FIGS. 10A, 10B and 10C illustrate the generation of an embossed image data with respect to photograph.
Figure 10B:
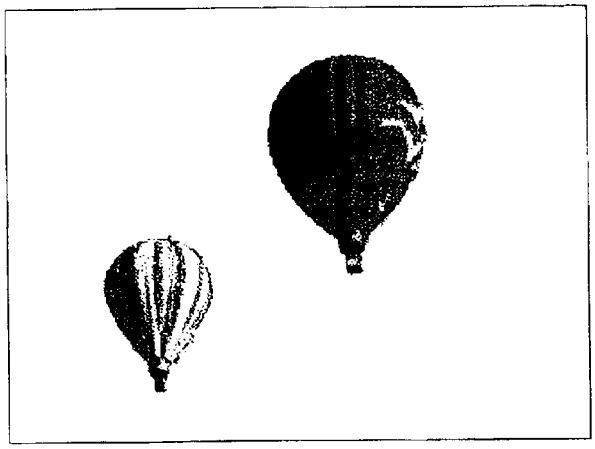
Figure 10C:
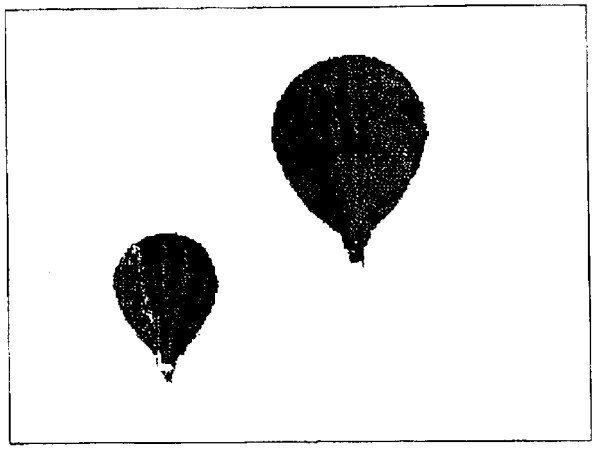

FIG. 10 illustrates an exemplary image processing for preparing an embossed image for a part of the non-embossed image whose type of image is photograph.

In photographs or landscape pictures, the quality of a picture tends to be determined by an object to be photographed or drawn as well as illumination conditions during the photograph shooting or drawing. Thus, when the gradation of lightness generated in the direction along which the object receives light during the shooting is corrected by using colorfulness, embossed image data of an intended quality can be obtained.

Figure 11:
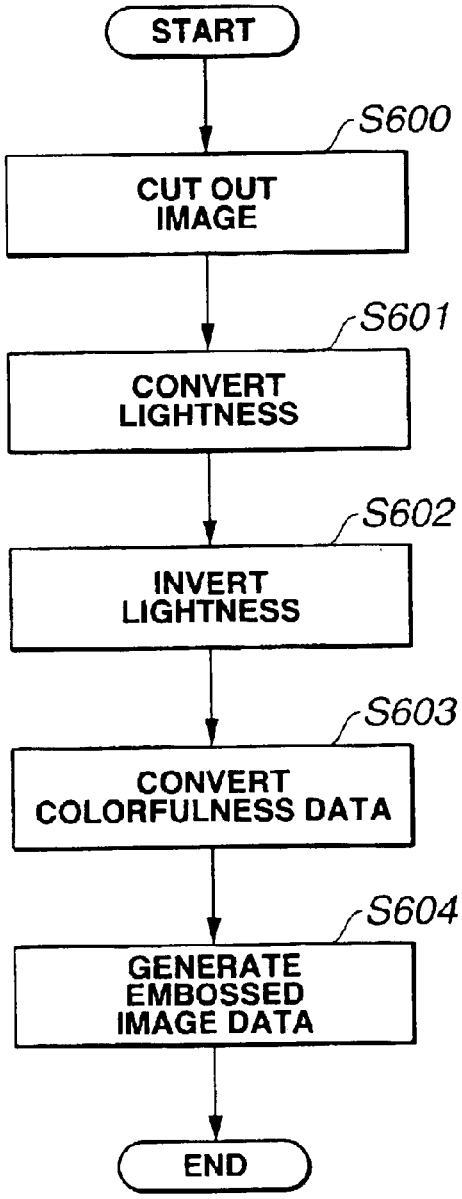
FIG. 11 is a flowchart illustrating a process of generating an embossed image data with respect of photograph or landscape picture.

FIG. 11 is a flowchart illustrating an exemplary flow of the processing for generating the embossed image data of a region specified by a user based on the non-embossed image shown in FIG. 10 whose type of image is photograph.

Referring to FIG. 11, first, a region of a non-embossed image from whish an embossed image is to be formed is cut out from the non-embossed image (step 600).

Then, lightness data representing the lightness of the non-embossed image is selected from the image attribute data (step 601), and the gradation of the lightness data is inverted (step 601).

Then, colorfulness data representing the colorfulness of the non-embossed image is selected from the image attribute data (step 602) to multiply the colorfulness data by the lightness whose gradation is inverted with an appropriate proportion (step 603), thereby generating an embossed image data (step 604).

In this way, the present invention make it possible to generate data of an embossed image from a two-dimensional image, thereby allowing the time required by conventional techniques for preparing data of an embossed image to be significantly reduced.

Furthermore, the present invention provides technique with which an embossed image data can be handled in the same manner as the data of a commonly-used color or monochrome image. With its versatile nature, the technique can be widely used for preparing printed matters having various embossed shapes.

The embossed image data may have the same form as in the density data of a non-embossed image. The higher the density data is, the greater the amount of embossing material such as foaming toner is per unit area, and thus a higher embossed image is formed. On the other hand, the lower the density data is, the smaller the amount of the embossing material per unit area, thus a lower embossed image is formed.

Furthermore, the present invention allows an embossed image data to be generated by using an optimal attribute value depending on the type of an original picture or the use of the resultant image. Thus, the present invention can provide a printed matter having an excellent design, which meets with the desired of users.

For the image of oil painting and wallpaper, an embossing data is generated by using the data of lightness and colorfulness so that oil painting or wallpaper having a unique embossed texture as the original picture has can be reproduced.

For the image of engraving and design picture, an embossed image data is generated by using the data of image density and lightness, and the patterns of the picture are emphasized based on the embossed image data so that a high-impact image or high quality printed matter can be reproduced.

For the image of line drawing, an embossed image data is generated by detecting the edge part of an original image from the data on the lightness, colorfulness, etc. and contour parts corresponding to the edge part are raised based on the embossed image data to emphasize a particular pattern of the picture so that a universal printed matter which can be also appreciated by visually-handicapped people.

For the image of landscape picture and photograph drawing or taking an embossed object, an embossed image data is generated by using the combination of data on colorfulness, lightness, image density, etc. so that the embossed object can be artificially reproduced as a pseudo-embossed object and an image having emphasized embossed feeling can be produced.

What is claimed is:

1. An image processing method, comprising:

extracting an attribute value from a non-embossed image data from which a non-embossed image is formed;

generating an embossed image data from which an embossed image is formed using the extracted attribute value; and transmitting the embossed image data and the non-embossed image data to an image formation apparatus, wherein the attribute value comprises at least one of lightness, colorfulness, edge of image and image density.

2. The image processing method according to claim 1, wherein the attribute value comprises lightness, colorfulness, edge of image and image density; and the embossed image data is generated using any combination of the attribute value.

3. The image processing method according to claim 1, further comprising the step of specifying the attribute value for generating the embossed image data, wherein the embossed image data is generated using the specified attribute value.

4. The image processing method according to claim 1, further comprising the step of specifying a region in the non-embossed image, wherein the embossed image data is generated for the specified region.

5. The image processing method according to claim 1, wherein data representing a height direction is the same as a data representing an image density.

6. An image formation method, comprising:

extracting an attribute value from a non-embossed image data from which a non-embossed image is formed;

generating an embossed image data from which an embossed image is formed using the extracted attribute value; and forming an image based on the embossed image data and the non-embossed image data;

wherein the attribute value comprises at least one of lightness, colorfulness, edge of image and image density.

7. An image processing apparatus, comprising:

attribute value extract means for extracting an attribute value from a non-embossed image data from which a non-embossed image is formed;

embossed image data generation means for generating an embossed image data from which an embossed image is formed using the attribute value extracted by the attribute value extract means; and transmission means for transmitting the embossed image data generated by the embossed image data generation means and the non-embossed image data to the image formation apparatus;

wherein the attribute value comprises at least one of lightness, colorfulness, edge of image and image density.

8. An image formation apparatus, comprising:

attribute value extract means for extracting an attribute value from a non-embossed image data from which a non-embossed image is formed;

embossed image data generation means for generating an embossed image data from which an embossed image is formed from the attribute value extracted by the attribute value extract means; and image formation means for forming an image based on the embossed image data generated by the embossed image data generation means and the non-embossed image data;

wherein the attribute value comprises at least one of lightness, colorfulness, edge of image and image density.

* * * * *